US009135894B2

(12) United States Patent
Chang

(10) Patent No.: US 9,135,894 B2
(45) Date of Patent: Sep. 15, 2015

(54) DATA ACCESS METHOD AND ELECTRONIC APPARATUS FOR ACCESSING DATA

(75) Inventor: Chih-Hao Chang, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 131 days.

(21) Appl. No.: 13/268,002

(22) Filed: Oct. 7, 2011

(65) Prior Publication Data

US 2012/0320072 A1 Dec. 20, 2012

(30) Foreign Application Priority Data

Jun. 17, 2011 (TW) ..... 100121259 A

(51) Int. Cl.
*G09G 5/39* (2006.01)
*G09G 5/393* (2006.01)

(52) U.S. Cl.
CPC ..... *G09G 5/393* (2013.01); *G09G 2350/00* (2013.01)

(58) Field of Classification Search
None
See application file for complete search history.

(56) References Cited

U.S. PATENT DOCUMENTS

| | | | | |
|---|---|---|---|---|
| 5,841,445 | A * | 11/1998 | Hamamatsu et al. | 345/540 |
| 2002/0126604 | A1* | 9/2002 | Powelson et al. | 369/47.53 |
| 2004/0199733 | A1* | 10/2004 | Watanabe et al. | 711/162 |
| 2005/0219970 | A1* | 10/2005 | Chou et al. | 369/44.26 |
| 2008/0129749 | A1* | 6/2008 | Wiley et al. | 345/545 |
| 2008/0159094 | A1* | 7/2008 | Lin | 369/44.32 |
| 2008/0165268 | A1* | 7/2008 | Takahashi et al. | 348/333.01 |
| 2008/0174540 | A1* | 7/2008 | Lee | 345/99 |
| 2008/0198181 | A1* | 8/2008 | Kondo et al. | 345/690 |
| 2009/0080301 | A1* | 3/2009 | Yasukawa et al. | 369/47.28 |
| 2009/0096797 | A1* | 4/2009 | Du et al. | 345/506 |
| 2011/0116185 | A1* | 5/2011 | Katagiri et al. | 360/73.04 |
| 2011/0191534 | A1* | 8/2011 | Ash et al. | 711/113 |
| 2011/0314233 | A1* | 12/2011 | Yan et al. | 711/154 |

FOREIGN PATENT DOCUMENTS

CN 101231835 A 7/2008

* cited by examiner

*Primary Examiner* — James A Thompson
*Assistant Examiner* — Xilin Guo
(74) *Attorney, Agent, or Firm* — WPAT, P.C.; Justin King

(57) ABSTRACT

A data access method applicable to a storage apparatus for reducing or eliminating an image tearing effect includes defining at least one write check point; comparing an actual write speed for writing data into the storage apparatus with a predetermined write speed at the write check point; and adjusting the actual write speed when a difference between the actual write speed and the predetermined write speed is larger than a predetermined value, for adaptively reducing the difference to be smaller than or equal to the predetermined value.

14 Claims, 5 Drawing Sheets

DATA ACCESS METHOD AND ELECTRONIC APPARATUS FOR ACCESSING DATA

CROSS REFERENCE TO RELATED PATENT APPLICATION

This patent application is based on Taiwan, R.O.C. patent application No. 100121259 filed on Jun. 17, 2011.

FIELD OF THE INVENTION

The present invention relates to a data access method and an electronic apparatus for accessing data, and more particularly, to a data access method for dynamically adjusting a write speed and an electronic apparatus for accessing data.

BACKGROUND OF THE INVENTION

In a conventional image processing apparatus, a process for displaying on a panel image data corresponding to an image frame typically includes: writing the image data into a storage apparatus, reading the image data of the image frame from the storage apparatus, and displaying the image data on the panel. However, due to asynchronization of an operating unit for writing the image data into the storage apparatus and that for reading the image data from the storage apparatus, a write speed for writing the image data into the storage apparatus is not identical to a read speed for reading the image data from the storage apparatus, and they are not necessarily be matched with each other. Also, a plurality of image data are displayed on the panel consecutively, i.e., the image processing apparatus consecutively writes and reads different image data into and from the storage apparatus. When a corresponding relationship between writing image data into the storage apparatus and reading image data from the storage apparatus is not appropriately adjusted, in an event that image data is read from the storage apparatus when another image data is being written into the storage apparatus at the same time, a new image frame displayed on the panel may overlap a previously present image frame, such that an incomplete image is displayed on the panel, resulting in an image tearing effect.

FIG. 1 shows a schematic diagram of a conventional image processing apparatus encountering the tearing effect. Referring to FIG. 1, "write 0" represents that an image frame 0 is written into the storage apparatus, and "read 0" represents that the image frame 0 is read from the storage apparatus. Likewise, "write 1" represents that an image frame 1 is written into the storage apparatus, "read 1" represents that the image frame 1 is read from the storage apparatus, and the like. As illustrated in FIG. 1, "read 1" and "write 2" do not intersect, and "read 2" and "write 3" do not intersect, which infer that they do not interfere with each other. However, "read 0" and "write 1" intersect, i.e., operations of reading the image frame 0 from the storage apparatus and writing the image frame 1 into the storage apparatus are simultaneously performed, which may result in the described tearing effect on the resultant panel.

SUMMARY OF THE INVENTION

One object of the present invention is to provide a data access method for preventing a tearing effect by adjusting a data write speed.

Another object of the present invention is to provide an electronic apparatus for preventing the tearing effect by adjusting a data write speed.

According to an embodiment of the present invention, a data access method applied to a storage apparatus comprises defining a write check point, which is a time point (i.e., a point in time); comparing an actual write speed for writing data into the storage apparatus with a predetermined write speed at the write check point; and adjusting the actual write speed when the difference between the actual write speed and the predetermined write speed is larger than a predetermined value, for reducing the difference between the actual write speed and the predetermined write speed to be smaller than or equal to the predetermined value.

According to another embodiment of the present invention, an electronic apparatus for accessing data comprises a storage apparatus and a processor, for controlling a write operation for writing data into the storage apparatus. The processor defines a write check point, which is a time point, compares a actual write speed for writing the data into the storage apparatus with a predetermined write speed at the write check point, and adjusts the actual write speed when a difference between the actual write speed and the predetermined write speed is larger than a predetermined value, for reducing the difference between the actual write speed and the predetermined write speed to be smaller than or equal to the predetermined value.

Accordingly, the write speed is maintained at an ideal status to improve apparatus efficiency as well as avoiding the tearing effect.

DETAILED DESCRIPTION OF THE PREFERRED EMBODIMENT

Certain terms are used throughout the description and the claims to refer to particular system components. As a person having ordinary skill in the art will appreciate, hardware manufactures may refer to a component by different names. This document does not intend to distinguish between components that differ in name but function. It is to be noted that, "comprise" mentioned throughout the description and appended claims has an open-ended meaning, i.e., "comprises but not be limited to". In addition, "couple" refers to any direct or indirect electrically connection means. Therefore, when it is described that a first apparatus is coupled to a second apparatus, it means that the first apparatus is directly electrically connected to the second apparatus or is indirectly electrically connected to the second apparatus via other apparatus or connection means.

Figure 1:
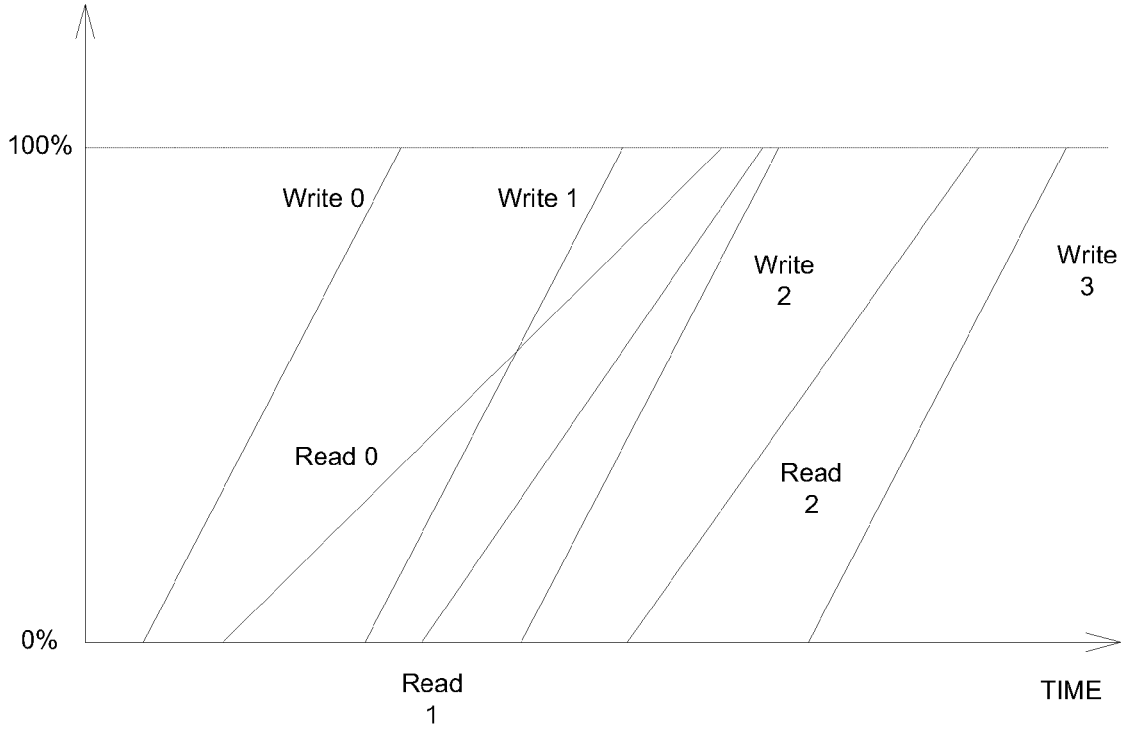
Figure 1 PRIOR ART
FIG. 1 is a schematic diagram of a conventional image processing apparatus generating a tearing effect of the prior art.
Figure 2:
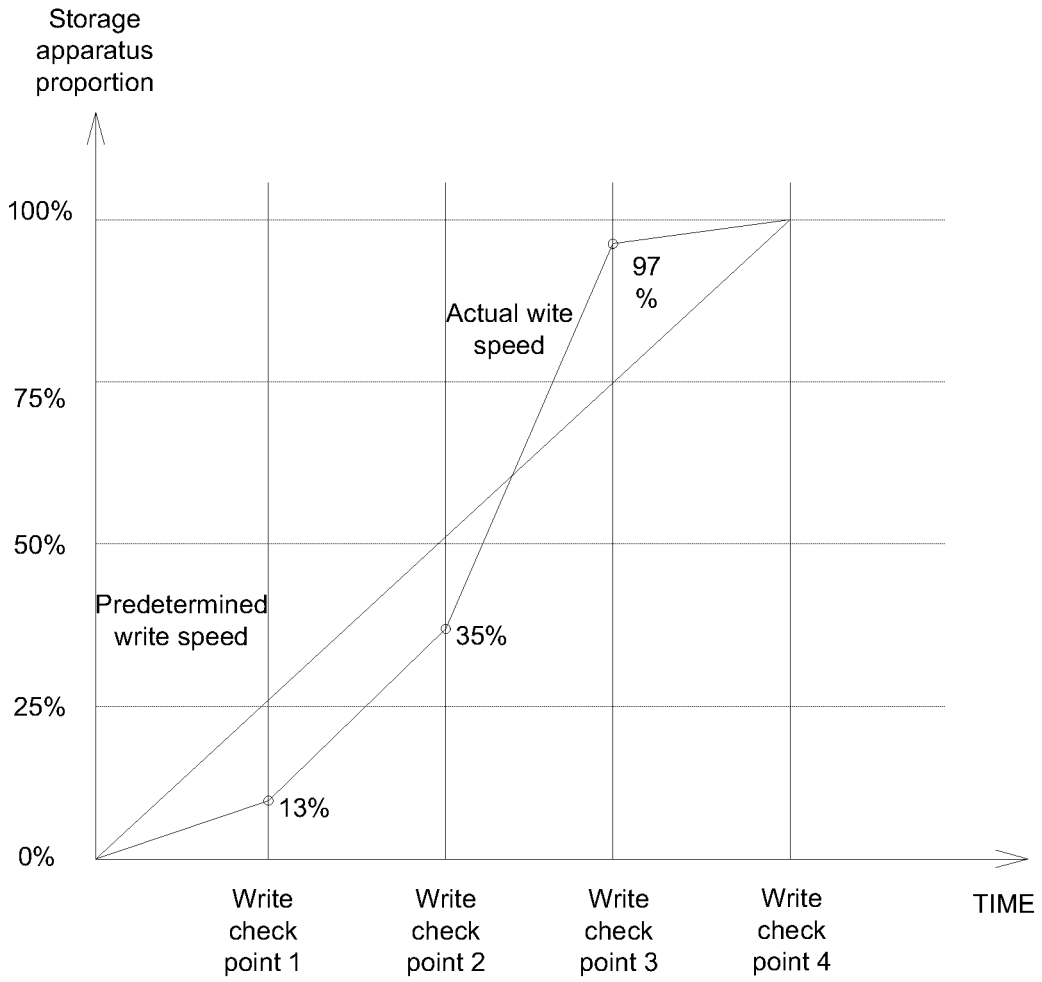
FIG. 2 is a schematic diagram of a data access method in accordance with an embodiment of the present invention.

FIG. 2 shows a schematic diagram of a data access method in accordance with an embodiment of the present invention. In this embodiment, the data access method includes defining at least one write check point, which is a time point; comparing a actual write speed with an ideal predetermined write speed at the time point; increasing the actual write speed when the actual write speed is slower than the predetermined write speed, and on the contrary, reducing the actual write speed when the actual write speed is faster than the predetermined write speed. According to one embodiment of the present invention, the step of comparing the actual write speed with the predetermined write speed includes: defining a predetermined accumulated write data amount (in this embodiment, the data amount is a pixel amount) corresponding to the write check point; detecting a actual accumulated write data amount of the storage apparatus at the write check point; and comparing the predetermined accumulated write data amount with the actual accumulated write data amount to calculate a relationship between the predetermined write speed and the actual write speed at the write check point. For example, referring to FIG. 2, at a write check point 1, the predetermined accumulated write data written into the storage apparatus occupies 25% of a total amount of the storage apparatus, whearas the actual accumulated write data amount only occupies 13% of the total amount of the storage apparatus, which infers that the actual write speed is too slow, thus it needs to be increased. At a write check point 3, the predetermined accumulated write data amount written into the storage apparatus occupies 75% of the total amount of the storage apparatus, whearas the actual accumulated write data amount occupies only 97% of the total amount of the storage apparatus, which infers that the actual write speed is too fast, thus it needs to be reduced, such that actual accumulated write data amount achieves 100% of the total amount at a write check point 4. In an embodiment, a counter is applied to count the accumulated write data amount.

It is to be noted that, the foregoing operation of comparing the actual write speed with the predetermined write speed is merely an exemplary embodiment, and shall not be construed as limitations of the present invention. For example, the difference between the actual write speed and the predetermined write speed may also be determined by observing data flows in other transmission channels of the image processing apparatus or data amounts of data processed by other associated components. Other conceivable variations are also within the scope of the present invention.

Figure 3:
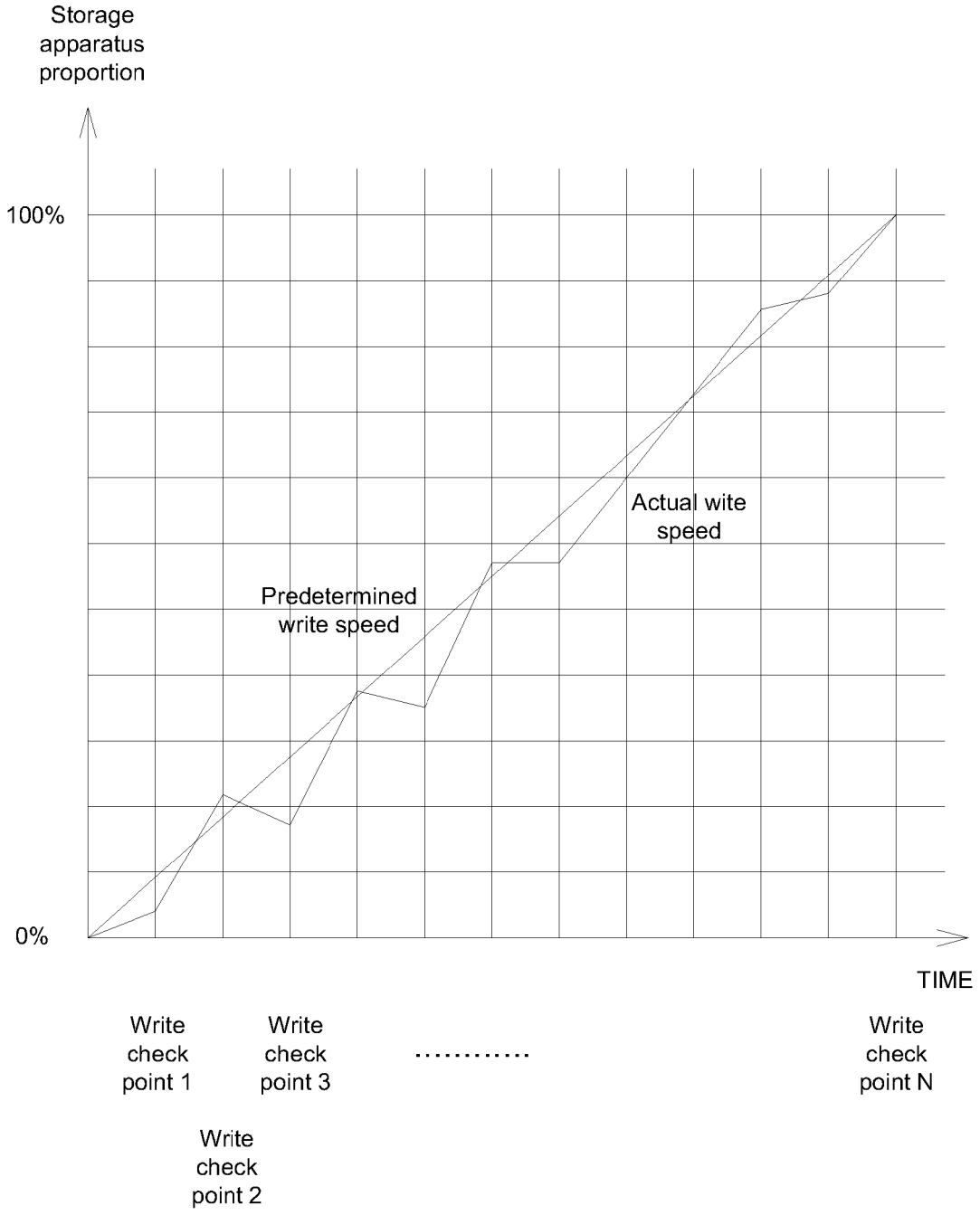
FIG. 3 is a schematic diagram of a data access method in accordance with another embodiment of the present invention.

The foregoing definition of the write check point is performed in various ways. For example, a time point when a write operation starts for a predetermined time period can be defined as the write check point. Alternatively, at least one time point during the write operation is randomly defined as the write check point, i.e., the actual write speed and the predetermined write speed are randomly compared. A time point at which a predetermined row of an image frame of the image data is written into the storage apparatus can be defined as the write check point, and the predetermined row can be a random row. A time point at which each row of the image frame is written into the storage apparatus can also be defined as the write check point. In addition, the number of write check points is related to an accuracy of determining whether the difference between the actual write speed and the predetermined write speed is smaller than the predetermined value. The number of the write check points in FIG. 3 is much larger than that of write check points in FIG. 2, so that the actual write speed in FIG. 3 follows the predetermined write speed in FIG. 3 more accurately.

The foregoing predetermined write speed is determined according to the speed of reading the image data from the storage apparatus. Alternatively, the predetermined write speed can be determined according to the speed of reading the image data from the storage apparatus and updating it on a panel. In addition, the predetermined write speed can be defined as any speed that can avoid the tearing effect when the image data is displayed on a panel.

According to an embodiment of the present invention, an approach for dynamically reducing the write speed includes lowering a priority of writing the image data in an operating unit, lengthening an idle time of the operating unit, and reducing a clock rate of the operating unit. On the contrary, an approach for dynamically increasing the write speed comprises raising the priority of writing the image data in the operating unit or increasing the clock rate of the operating unit.

In addition, the foregoing operation can be abbreviated as follows: defining at least one write check point; comparing a actual write speed for writing data into the storage apparatus with a predetermined write speed at the write check point; and adjusting the actual write speed when the difference between the actual write speed and the predetermined write speed is larger than a predetermined value (e.g., the predetermined value is 0 or other numbers), so as to reduce the difference between the actual write speed and the predetermined write speed to be smaller than or equal to the predetermined value.

Figure 4:
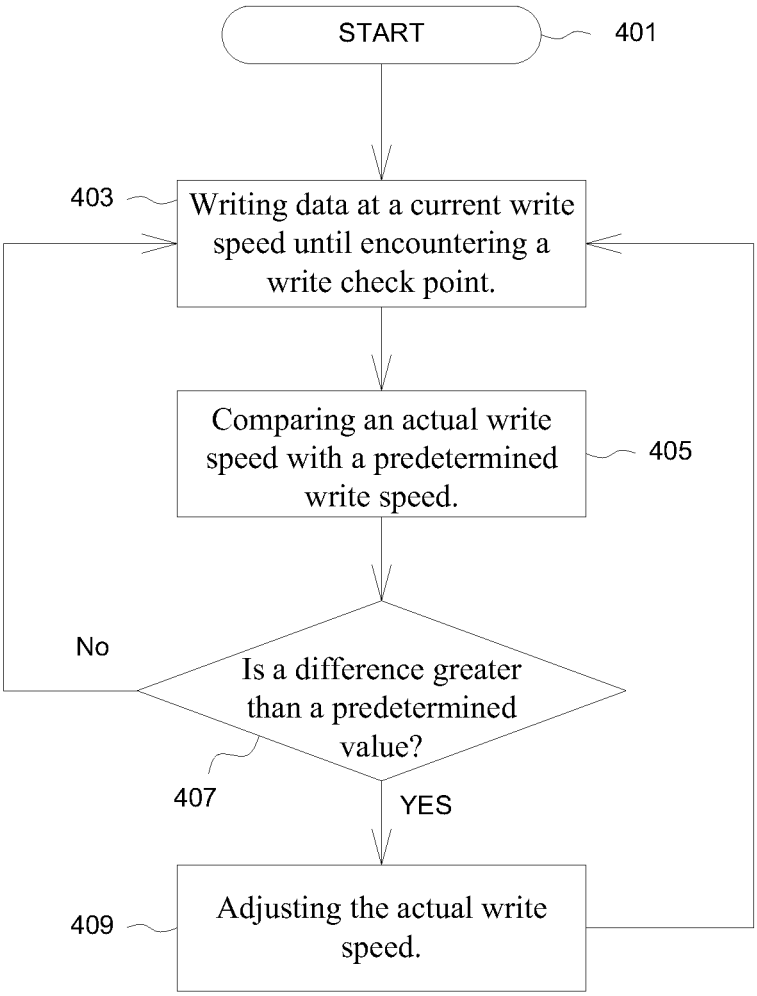
FIG. 4 is a flowchart of a data writing process in accordance with an embodiment of the present invention.

FIG. 4 is a flowchart of a data writing process in accordance with an embodiment of the present invention. In Step 401, the starting writing of data begins. In Step 403, consecutively writing data at a current write speed continues until encountering a write check point. In Step 405, comparing an actual write speed with a predetermined write speed is performed. In Step 407, determining whether a difference between the actual write speed and the predetermined write speed is greater than a predetermined value is performed. When the answer is positive, the process proceeds to Step 409 for adjusting the actual write speed (e.g., increased or reduced), and then returns to Step 403; when the answer is negative, the process returns to Step 403 without adjusting the write speed.

Figure 5:
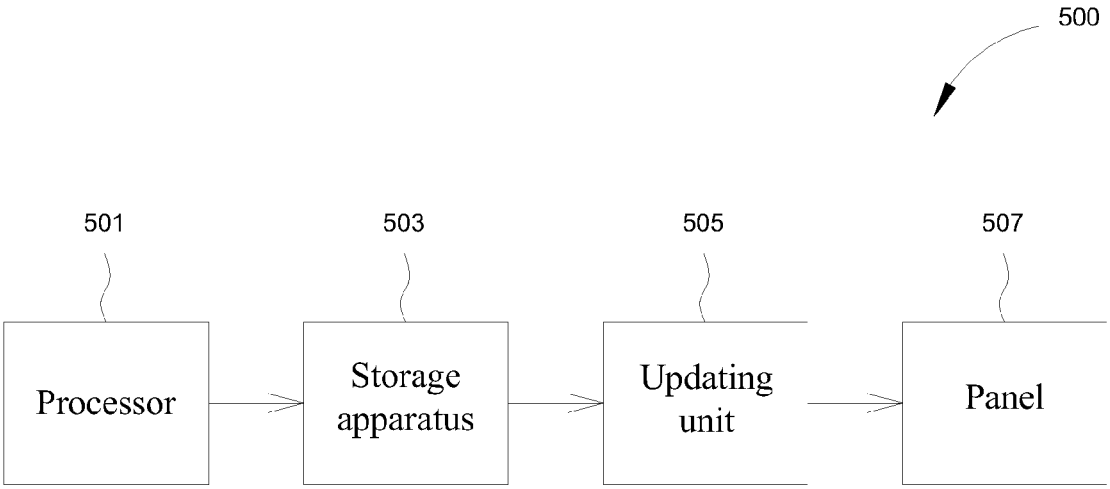
FIG. 5 is a block diagram of an image processing apparatus for performing a data access method in accordance with an embodiment of the present invention.

FIG. 5 is a block diagram of an image processing apparatus 500 for performing a data access method in accordance with an embodiment of the present invention. The image processing apparatus 500 comprises a processor 501, a storage apparatus 503, an updating unit 505, and a panel 507. The processor 501 controls a write operation for writing image data into the storage apparatus 503, and the updating unit 505 reads the image data from the storage 503 and updates the image data on the panel 507, so that the panel 507 displays an updated image frame. An approach for adjusting the actual write speed comprises at least one of following manners: adjusting a priority of the write operation in the processor 501, adjusting an idle time of the processor 501, and adjusting a clock rate of the processor 501 to adjust a processing speed. In addition, the foregoing predetermined write data amount is determined according to a loading of the processor 501. Other detailed features of the image processing apparatus 500 are easily obtained form the foregoing description, and are hereby omitted herein.

It is to be noted that, although the image data and the image processing apparatus are described in the foregoing embodiments, they shall not be considered limiting or restrictive in connection with the present invention and its various embodiments, and other data and image processing apparatuses shall also be within the spirit and scope of the present invention.

According to the foregoing embodiment, the write speed is maintained at an ideal status to increase apparatus efficiency as well as avoiding the tearing effect in the prior art.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A data access method, applied to a storage apparatus for outputting an image frame to a panel, comprising:

performing a first write speed check operation at a predetermined point in time from a start of a write operation, comprising:

comparing a first predetermined accumulated written data amount corresponding to the first write check point to a first actual accumulated written data amount; and adjusting actual write speed to the storage apparatus when a difference between the first predetermined accumulated written data amount and the first actual accumulated written data amount is greater than a predetermined value;

performing a second write speed check operation at a randomly defined point in time after the first write check operation, comprising:

comparing a second predetermined accumulated written data amount corresponding to the second write check point to a second actual accumulated written data amount; and adjusting actual write speed to the storage apparatus when a difference between the second predetermined accumulated written data amount and the second actual accumulated written data amount is greater than a predetermined value; and performing a third write speed check operation when a predetermined row of said image frame is written into the storage apparatus, comprising:

comparing a third predetermined accumulated written data amount corresponding to the third write check point to a third actual accumulated written data amount; and adjusting actual write speed to the storage apparatus when a difference between the third predetermined accumulated written data amount and the third actual accumulated written data amount is greater than a predetermined value.

2. The data access method of claim 1, wherein the number of the write check points is associated with an accuracy for determining whether the difference is smaller than the predetermined value.

3. The data access method of claim 1, wherein the predetermined write speed is determined according to a speed of reading the data from the storage apparatus.

4. The data access method of claim 1, wherein the data is image data, and the predetermined write speed is determined according to a speed of reading the image data from the storage apparatus and updating the image data on a panel.

5. The data access method of claim 1, wherein the data is image data, and the predetermined write speed is defined in a way that the image data displays on a panel without occurrence of a tearing effect.

6. The data access method of claim 1, further comprising controlling a write operation for writing data into the storage apparatus via a processor, wherein the first predetermined accumulated written data amount and the second predetermined accumulated written data amount are determined according to a loading of the processor.

7. The data access method of claim 1, further comprising controlling a write operation for writing data into the storage apparatus via a processor, wherein the step of adjusting the actual write speed comprises at least one of following steps: adjusting a priority of the write operation in the processor, adjusting an idle time of the processor and adjusting a clock rate of the processor.

8. An electronic apparatus for accessing data, comprising:

a storage apparatus; and a processor, for controlling a write operation for writing data into the storage apparatus;

wherein the processor performs a first write speed check operation at a predetermined point in time from a start of a write operation, the first write speed check operation comprising:

comparing a first predetermined accumulated written data amount corresponding to the first write check point to a first actual accumulated written data amount; and adjusting actual write speed to the storage apparatus when a difference between the first predetermined accumulated written data amount and the first actual accumulated written data amount is greater than a predetermined value;

the processor further performs a second write speed check operation at a randomly defined point in time after the first write check operation, the second write speed check operation comprising:

comparing a second predetermined accumulated written data amount corresponding to the second write check point to a second actual accumulated written data amount; and adjusting actual write speed to the storage apparatus when a difference between the second predetermined accumulated written data amount and the second actual accumulated written data amount is greater than a predetermined value; and the processor further performs a third write speed check operation when a predetermined row of said image frame is written into the storage apparatus, the third write speed check operation comprising:

comparing a third predetermined accumulated written data amount corresponding to the third write check point to a third actual accumulated written data amount; and adjusting actual write speed to the storage apparatus when a difference between the third predetermined accumulated written data amount and the third actual accumulated written data amount is greater than a predetermined value.

9. The electronic apparatus of claim 8, wherein the processor defines a plurality of write check points, and the number of the write check points is associated with an assigned accuracy for determining whether the difference is smaller than the predetermined value.

10. The electronic apparatus of claim 8, wherein the predetermined write speed is determined according to a speed of reading the data from the storage apparatus.

11. The electronic apparatus of claim 8, being an image processing apparatus comprising a panel, wherein the data is image data, and the predetermined write speed is determined according to a speed of reading the data from the storage apparatus and updating the image data on the panel.

12. The electronic apparatus of claim 8, being an image processing apparatus that comprises a panel, wherein the data is image data, and the predetermined write speed is defined in a way that the image data displays on a panel without occurrence of tearing effect.

13. The electronic apparatus of claim 8, wherein the predetermined accumulated written data amount is determined according to a loading of the processor.

14. The electronic apparatus of claim 8, wherein the processor adjusts the actual write speed according to at least one of following steps: adjusting a priority of the write operation in the processor, adjusting an idle time of the processor and adjusting a clock rate of the processor.

* * * * *